US006820655B2

(12) United States Patent
Beeh

(10) Patent No.: US 6,820,655 B2
(45) Date of Patent: Nov. 23, 2004

(54) LOOM AND ROOM CONDITIONING SYSTEM

(76) Inventor: Hans Adolf Beeh, Chacabuco 96, 2 piso, 1069 Buenos Aires (AR)

( * ) Notice: Subject to any disclaimer, the term of this patent is extended or adjusted under 35 U.S.C. 154(b) by 230 days.

(21) Appl. No.: 10/104,164

(22) Filed: Mar. 22, 2002

(65) Prior Publication Data

US 2003/0178089 A1 Sep. 25, 2003

(51) Int. Cl.[7] ..... D03C 13/00
(52) U.S. Cl. ..... 139/1 C; 139/1 R; 139/36
(58) Field of Search ..... 139/1 C, 1 R, 139/36

(56) References Cited

U.S. PATENT DOCUMENTS 1,801,830 A * 4/1931 Winstanley et al. ..... 239/220
2,526,848 A * 10/1950 Campbell ..... 118/709
3,906,261 A * 9/1975 Ogura et al. ..... 310/12
4,444,292 A * 4/1984 Brown et al. ..... 184/6
4,635,684 A * 1/1987 Hintsch ..... 139/1 R
4,901,766 A * 2/1990 Krumm ..... 139/36
5,012,546 A * 5/1991 Kuwabara et al. ..... 15/301
5,472,018 A * 12/1995 Verner et al. ..... 139/1 C
5,727,601 A * 3/1998 Krumm ..... 139/449
6,006,790 A * 12/1999 Cooper ..... 139/1 C
6,491,068 B1 * 12/2002 Markward et al. ..... 139/1 R
6,604,553 B1 * 8/2003 Speich ..... 139/1 R

* cited by examiner

*Primary Examiner*—John J. Calvert
*Assistant Examiner*—Robert H. Muromoto, Jr.
(74) *Attorney, Agent, or Firm*—Pendorf & Cutliff

(57) ABSTRACT

The invention relates to an improvement in the art of loom and weaving room conditioning, in which the necessary moisture required by the yarn to perform best in the loom is metered exactly and directly on the yarn, whereby yarn breakage is reduced and weaving air room humidity can be lowered, thereby improving human comfort. Lint and dust generated by the weaving process are removed at their source so air contamination is lowered, improving hygienic conditions and reducing air filtration requirements. Heat generated by the weaving process is partly removed by water-cooling the lubricating oil, thereby reducing the weaving room heat load. Large peripherally located air conditioning units are replaced by smaller units, distributed over or under the roof of the room, each serving the area of 4–24 looms.

4 Claims, 11 Drawing Sheets

LOOM AND ROOM CONDITIONING SYSTEM

FIELD OF THE INVENTION

The invention deals with a system for the improvement of loom efficiency, the comfort and the hygienic conditions within the weaving room and for the reduction of the energy needed for the conditioning of the air in the weaving room. These goals are obtained by precisely controlling the moisture content of the yarn being fed into each loom by removing solids and heat generated by the weaving process at their source, and by improving the handling of the air in the weaving room.

BACKGROUND

Woven fabrics are made up by combining warp yarn (lengthwise) with filling yarn (widthwise), in such a way as to obtain the desired look and strength of the fabric.

Warp beams, containing the necessary number of ends, are fed into the loom (weaving machine). Please see FIG. 1, item [1]. Every end is conducted through a break detector [2], by which the machine is stopped in case of a warp break.

The ends are risen and lowered by the heddles [4] forming the shed [3]. The filling yarn [5] is inserted within the shed and pressed by the reed [6] towards the exiting fabric [7].

Loom speed has increased over the time from a few picks per minute (ppm) to about 1000 presently. By the yarn movement in the shed, warp yarns are subjected to very frequent tensioning and yarn-to-yarn abrasion. To prevent warp breaks, said yarn should have: high tensile strength and elasticity, no weak points nor adhering in fiber bundles (slubs), very low hairiness.

An adequate yarn humidity is needed to enhance the strength and the elasticity and to smoothen the yarn surface.

The following descriptions and statements are especially valid for products made up by natural fibers and their blends with synthetic and artificial fibers.

Both tensile strength and elasticity depend on fiber and spinning characteristics, on warp pretreatment (slashing) and increase with moisture content of the yarn being fed into the weaving process.

Hairiness depends on the spinning system and the fiber quality. It is reduced by slashing, as fibers protruding from the yarn are glued to it. Moisture content smoothens the hairs and lubricates the yarn surface.

Abrasion between yarns, mainly in the shed area, removes short fibers (lint) and size dust from the warp yarn. Adequate yarn moisture reduces the fall out.

While the weaving process is performed, the following interactions occur: The yarn adsorbs water from the air. Lint and dust falling out from the yarn are incorporated into the room air. Power consumed by the loom and other devices in the room is converted into heat and incorporated into the room air.

Experience shows that yarns perform best in weaving machines when their humidity is 7–9% (parts of water in 100 parts of dry yarn). Less humidity reduces strength, elasticity and smoothness. Higher moisture may make the size glue the warp yarns together.

Historically weaving mills were located in cool damp areas, looms run at a fraction of present speeds, and the yarn was stored for weeks inside the weaving room. When the mills were relocated to warmer and dryer climates, air conditioning systems were installed, in order to replicate the former conditions.

Yarn exposed to humid air adsorbs water, and after several hours, reaches an equilibrium. Present high-speed looms expose the yarn (especially the warp) for just a few minutes to the room air. This time is not long enough to obtain an adequate humidity level on the yarn.

In lab tests conducted with cotton yarns, the following yarn moistures have been measured before and after exposing it to air held at 25° C.:

| Air humidity | % | 40 | 50 | 60 | 70 | 80 | 90 |
|---|---|---|---|---|---|---|---|
| Yarn correctly dried in slasher, moisture content | | | | | | | |
| Before exposure | % | 5.6 | 5.6 | 5.6 | 5.6 | 5.6 | 5.6 |
| After 15 minutes exposure | % | 5.5 | 5.7 | 5.9 | 6.0 | 6.2 | 6.5 |
| After 24 hours exposure | % | 5.4 | 6.3 | 6.8 | 8.4 | 10.4 | 13.7 |
| Yarn over-dried in slasher, moisture content | | | | | | | |
| Before exposure | % | 2.3 | 2.3 | 2.3 | 2.3 | 2.3 | 2.3 |
| After 15 minutes exposure | % | 2.7 | 3.0 | 3.3 | 3.7 | 4.3 | 5.4 |
| After 24 hours exposure | % | 5.2 | 6.2 | 7.0 | 8.4 | 10.6 | 13.6 |

Warp yarns usually are dried by the slashers to 5–6% moisture. But during stops, part of the yarn is grossly over dried to 1–2% moisture. Most warp yarn breaks are concentrated in these parts.

Filling yarn moisture falls within the 3–7% range, depending mainly on the spinning technology employed. Sometimes yarn conditioning prior to weaving is required.

Yarn exposure to the room air during the weaving process is as short as 15 minutes or less. As shown in the tables above, by present methods, the weaving process would run best with a very high room humidity level, in the 85–95% range.

But operator comfort imposes a limit, usually 70–75%. Room temperature is frequently kept within the 24–26° C. range.

Recently two companies (LUWA-Bahnson and LTG Air Engineering) introduced systems projecting cool nearly saturated air from about 1500 mm over the shed on the yarn. Better loom performance has been reported.

Observations made in several cotton mills showed that solids fall-out has the following distribution:

| | |
|---|---|
| Warp, from beam to break detectors | 5–10% of total |
| Warp, from break detectors to heddles | 70–80% |
| Warp, after heddles | 5–10% |
| Filling | 5–10% |

In modem weaving mills, contaminated air is usually returned to the AC, located outside of the room, through openings under the looms. Solids are removed by filtration and/or water sprayed into the air stream. As an important part of the solids in the room are carried upward by the heat generated by the looms, only about 30–40% of the total fall out is captured by this system.

In order to keep the shed, the upper part of the weaving machines, and floor lint free, a device usually described as "traveling cleaner" moves along several machines, periodically blowing solids away from those parts and vacuuming off another 25–30% of the total.

The remainder of the lint and dust is moved by air turbulence all over the room and clings to the machines, the ducts, the light fixtures, the ceiling, and the walls. Its removal has to be performed by hand.

Increased machine speed requires a high power input (4–8 kw per loom). This energy is totally converted into heat and dissipated into the room air. The already mentioned traveling cleaners and the illumination also add to the room heat load. As the air heat capacity is very low, huge volumes of air have to be carried by the AC system from and back to the loom area.

Relatively large areas of the weaving room (each occupied by 40–120 looms) are served by each AC system, consisting of several openings under each loom, through which contaminated air is returned by underground air ducts to the AC unit. Within said AC unit, the air is filtered, sprayed with chilled water, cooled, and humidified to 95–97%, and finally propelled by fans through overhead ducts, to be uniformly distributed over the area served.

Provisions are made to replace returned air by fresh outside air, when external conditions are favorable. The chilled water mentioned above usually is cooled by compressors.

Relevant prior art includes Shofner U.S. Pat. Nos. 5,676,177 & 5,910,598, Chern U.S. Pat. No. 4,966,017 and Vignoni U.S. Pat. No. 5,275,350.

Shofner U.S. Pat. Nos. 5,676,177 & 5,910,598 deal mainly with the elimination of solids from the shed with devices that are bulky and very difficult to locate in an operating weaving machine, also interfering with the operator, while the blowers add heat to the air, thereby drying the yarn.

Chern U.S. Pat. No. 4,966,017 discloses a method and apparatus for moistening creels feeding other machines.

Vignoni U.S. Pat. No. 5,275,350 discloses a device to improve creel-operating conditions wherein the air is received and goes back to a centralized generator.

Shofner U.S. Pat. No. 5,910,598, although also discloses a room environmental improvement, has different ways of obtaining it regarding solid and heat removal with respect of present invention.

The following descriptions and statements are especially valid for products made up by natural fibers and their blends with synthetic and artificial fibers.

Tensile strength: Depends on fiber and spinning characteristics, on warp pretreatment (slashing) and on moisture content of the yarn being fed into the weaving machine.

Elasticity: Natural fibers elasticity increases with their moisture content.

Hairiness: Depends mainly on the spinning system. Is reduced by slashing, as fibers protruding from the yarn are glued to it. Yarn moisture content smoothens the hairs.

Lint and dust fall out: Abrasion between yarns, mainly in the shed area, removes short fibers (lint) and size dust from the warp yarn. Adequate yarn moisture reduces the fall out.

Yarn humidity (moisture): As seen above, an adequate humidity level on the yarn improves its performance in the weaving process.

SUMMARY OF THE INVENTION

In brief, the system of the invention comprises four subsystems. Each of the subsystems performing a definite task separately.

Subsystems are:

[A] The necessary moisture required by the yarn to perform best in the loom is metered exactly and directly on the yarn. Thereby, yarn breakage is reduced and weaving room air humidity can be lowered, thereby improving human comfort.

[B] Lint and dust generated by the weaving process are removed at their source. Air contamination is lowered, thereby improving hygienic conditions and reducing air filtration requirements and making traveling cleaners unnecessary.

[C] Heat generated by the weaving process is partly removed by water-cooling the lubricating oil of the weaving machine, thereby reducing the weaving room heat load.

[D] Large peripherally located air conditioning units are replaced by smaller units, distributed over or under the roof of the room, each serving the area of 4–24 looms. Due to subsystems [A, B, C], filtration and cooling requirements are greatly reduced. Air humidification is not needed. The fan & coil conditioning system is best suited for this application.

Subsystems [A, B, C] are operated on each loom separately, thereby increasing production flexibility. Loom efficiency is increased as yarn breaks are lowered to less than half.

Conditioned air will be projected on the aisles of work place. Room air will be collected for recycling at a higher level. Thereby turbulences, usually produced by ascending warm air, are prevented. Under floor air ducts are no longer necessary.

Due to subsystems A, B, C, less air will have to be turned over. Due to decentralization of AC units, said air will be transported over shorter distances. Thereby, substantial amounts of energy are saved.

By subsystem D, lesser air ducts are needed, thereby reducing investment costs. By elimination of under ground ducts and openings in the floor, replacement or rearrangement of weaving machines is made easier.

DESCRIPTION OF THE INVENTION

Yarn Moistening

As seen above, warp yarn moistening by humid air requires more time than available in modern weaving machines. Almost immediate water adsorption by the fibers can be achieved by several alternative means, such as: water aerosol in saturated air (fog), micro foam, by screen-printing water gels on the warp, and others.

Figure 1:
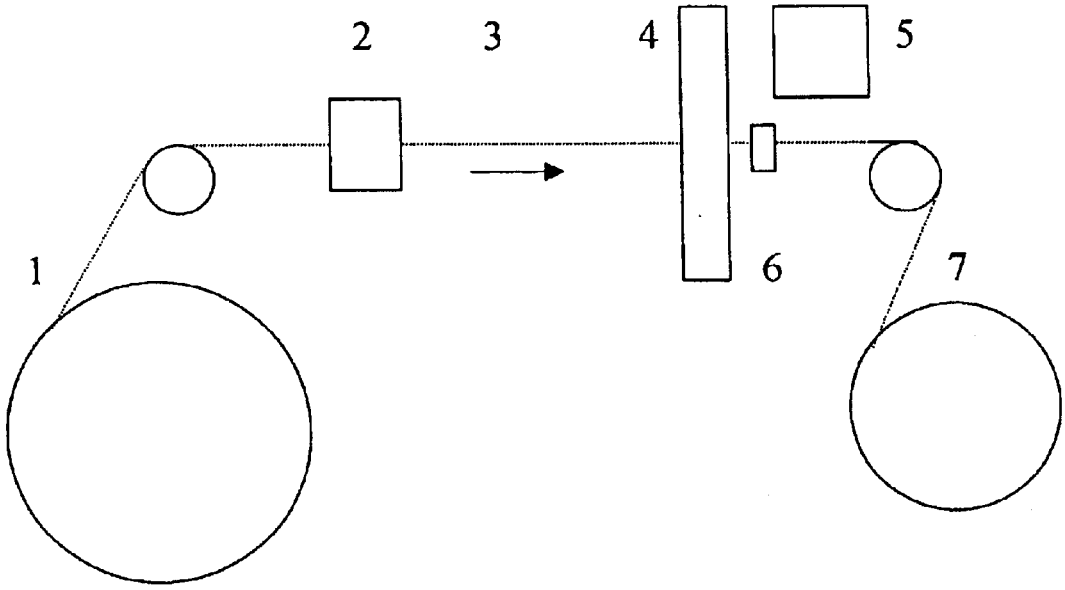
FIG. 1 is a schematic view of loom and weaving process.
Figure 2:
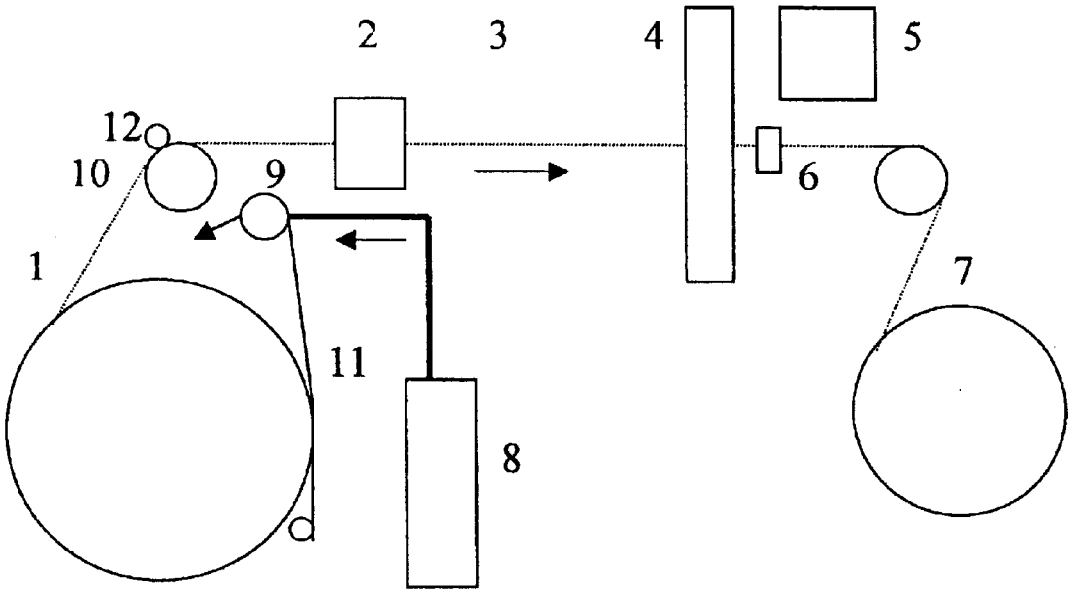
FIG. 2 is a schematic view of the warp yarn moistening device and its location within the loom.

In this application, the preferred water vehicle is a cool water aerosol in saturated air (fog), made up in-situ for every loom. See FIG. 2. Said fog is generated within a fogger, an especially designed device [8], to be described below.

Fog Generating Device (Fogger)

Fog is generated dispersing (atomizing) water into very tiny droplets (about 10 microns) into an air stream. A part of those water droplets evaporates, another part aggregates into larger drops, and the remaining fine droplets are incorporated into a stable and cool fog.

Both those droplets and the fibers, of which yarns are made up, have huge specific surfaces. For this reason, a strong reciprocal attraction results, and adsorption of the droplets by the fibers is almost instantaneous.

Water can be atomized by several known devices, such as water and compressed air nozzles, high-pressure water nozzles, ultrasound dispersers, high-speed rotors, etc. For practical reasons in this application, nozzles powered by compressed air are preferred.

Figure 3:
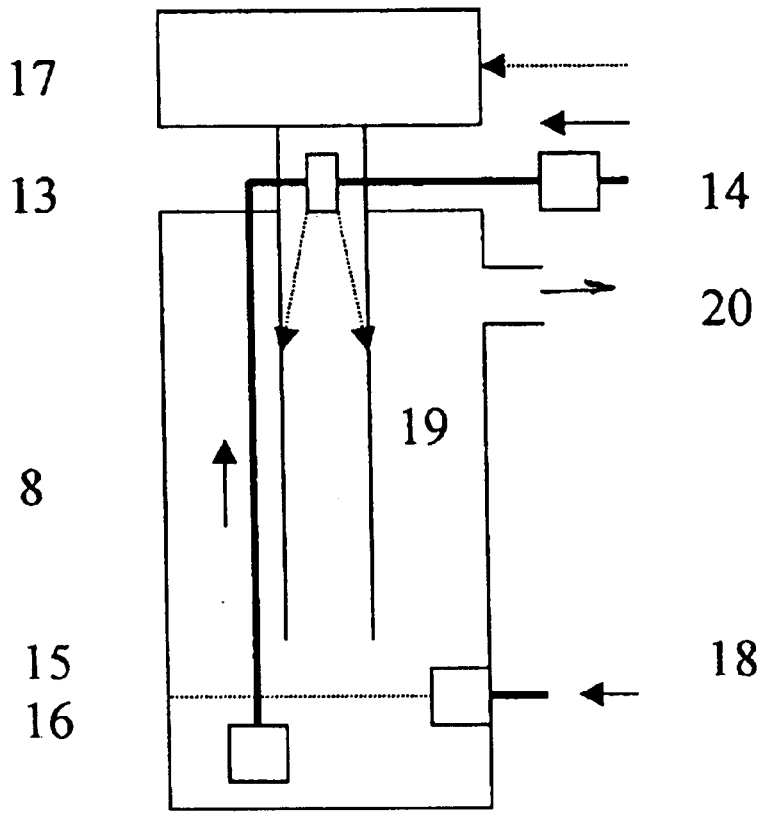
FIG. 3 is a schematic representation of the water in aerosol generating device.

Inside fogger [8] in FIG. 3, the nozzle [13] powered by compressed air entering through valve [14], aspires water from the bottom of the fogger through tube and water filter [16]. The primary fog emerging from the nozzle at high velocity creates a vacuum, thereby inducing a strong flow of secondary air, entering the fogger through air filter [17].

The raw fog is guided by the tube [19] towards the water level at the bottom, where the coarser drops are retained. The stable fog rises at low speed towards exit [20].

The level controller [18] replenishes water consumed.

Alternatively, for practical reasons, the vertical airflow fogger described may be designed to operate on the same principle but with horizontal fog flow.

In some applications, a higher fog flow rate may be convenient. In those instances, a booster fan will be installed between air filter [17] and nozzle [13].

Warp Yarn Moistening

A tube leads the fog generated to the plenum [9], from which it is blown towards the incoming warp [1]. A flexible sheet [11] prevents the fog from being carried away by air currents.

The sensor [12] measures the electrical resistance of the yarn, sends an electrical signal to a moisture controller. Said controller translates said signal into moisture content and adjusts automatically the amount of fog blown on the warp. Thereby, the desired moisture level, determined by the set point, is maintained on the warp.

Filling Yarn Moistening

Frequently filling yarn does not require any moistening. If required, an adequate amount of fog is conducted from the fogger [8] by a tube [53] towards the creel where the filling yarn bobbins are located. For details, see the description of the filling yarn lint removal.

Lint and Dust Removal

Lint and Dust Removal from Warp Yarns in the Shed

As already stated, lint and dust fall out is heavier in the shed [3] area between the warp yarn break detectors [2] and the heddles [4]. In this area, the alternating movements of the warp yarn and of the heddles produce strong air displacements. Additionally, heat generated by the weaving process induces an ascending airflow. The resulting turbulences carry the lint and dust, detached by abrasion from the yarn, in several directions.

Usual methods, as mentioned in "Background", do a very poor solids removal job. Air contamination is heavy and makes intensive air filtration necessary. Cleaning aids, such as traveling cleaners, are a must. In spite of those efforts, lint and dust accumulate on the weaving machines, the AC ducts, the walls, and the ceiling.

F. M. Shofner (U.S. Pat. Nos. 5,910,598 and 5,676,177) has dealt with this situation. He correctly concluded that the approach should be modular, and that the solids removal should be from close to their sources. In the various embodiments in those patents, the devices described for the removal of said solids by air flow are located at distances between 100–300 mm from the warp yarns in the shed area.

Others tried to enclose the whole loom or several specific areas. Those approaches resulted unpractical for two reasons: On one hand, the machine and the process are very complex and require frequent overseeing and repair. Any hindrance to easy and quick access is not welcome.

On the other hand, to carry lint and dust, air speed has to be high. Places within the enclosure where air speed is low accumulate solids very fast. For this reason, said approaches failed, such as Sulzer's multished weaving machine.

In order to overcome the drawbacks described above, in the present invention, the following embodiments are preferred.

In the shed area between the break detectors and the heddles, where solids generation is highest, lint and dust will be removed by the vacuuming device [22], while the cover [23] will prevent them from being carried away by air turbulences. See FIGS. 4 and 5. Both, the vacuuming device and the cover, will be installed in such a way as to be in contact with the warp yarns. The cover [23] will be automatically removed during loom stops, in such a way as to allow access for repairs.

To accelerate the separation of loose lint and dust from the yarn, some kind of mechanical action may be applied on the warp, such as air jets, brushing, vibration etc. In this invention, air jets are preferred.

The cover and the vacuuming device will be at least as wide as the incoming warp. Its length (in the direction of the warp) will be between 100 and 400 mm, according to loom and product characteristics.

The vacuuming device's [22] flat upper surface [22A] will be in contact with the lower share of warp yarns. It will have between 1 and 4 narrow slots [24] over its whole width, through which air will be suctioned at high velocity into chamber [22B]. This chamber will be shaped in such a way as to assure an even airflow and to prevent lint and dust accumulation.

Said air will enter the vacuum plenum [25] through slot [25A]. Air will be withdrawn from the plenum by an air-recycling device, to be described later.

The width of the loom and of the vacuuming device may range between 1000 and 4000 mm. If no special measures are taken, relevant differences in air velocity and vacuum within the plenum will occur. To assure uniform vacuum within plenum [25], any of the following embodiments will be applied:

Shaping the plenum conically. (2) Dividing the plenum into independent sections, each between 400–800 mm wide.

(3) Reversing airflow direction within the plenum frequently (from left-right to right-left), thereby compensating the differences (4). Any combination of (1), (2) and (3). The preferred embodiment is (3), reversing the airflow automatically in periods of less than 30 seconds.

The cover [23] will be in close contact with the upper share of warp yarns. Any of the following three alternatives will be applied:

A clear plastic cover [26], when solids fall out is moderate. (2) A plenum [27] with a perforated plate [28], through which air is blown at low velocity on the warp. (3) A plenum [27] with 1 to 4 narrow slots [28], through which air is blown at high velocity on the warp. Said slots are placed over slots [24] of the vacuuming device [22]. This alternative is indicated when fall out is heavy.

An adequate under pressure will be maintained within the area enclosed by cover [23] and device [22]. Air incoming from the room will have a higher velocity than solids within the enclosure.

Figure 4:
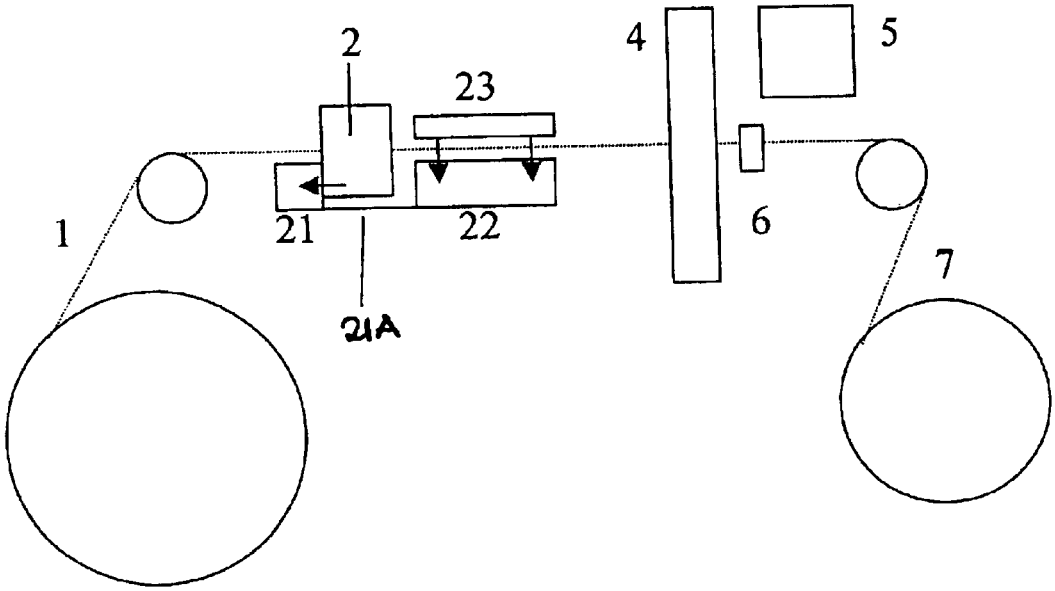
FIG. 4 is a schematic view of the warp lint and dust removal device.
Figure 5:
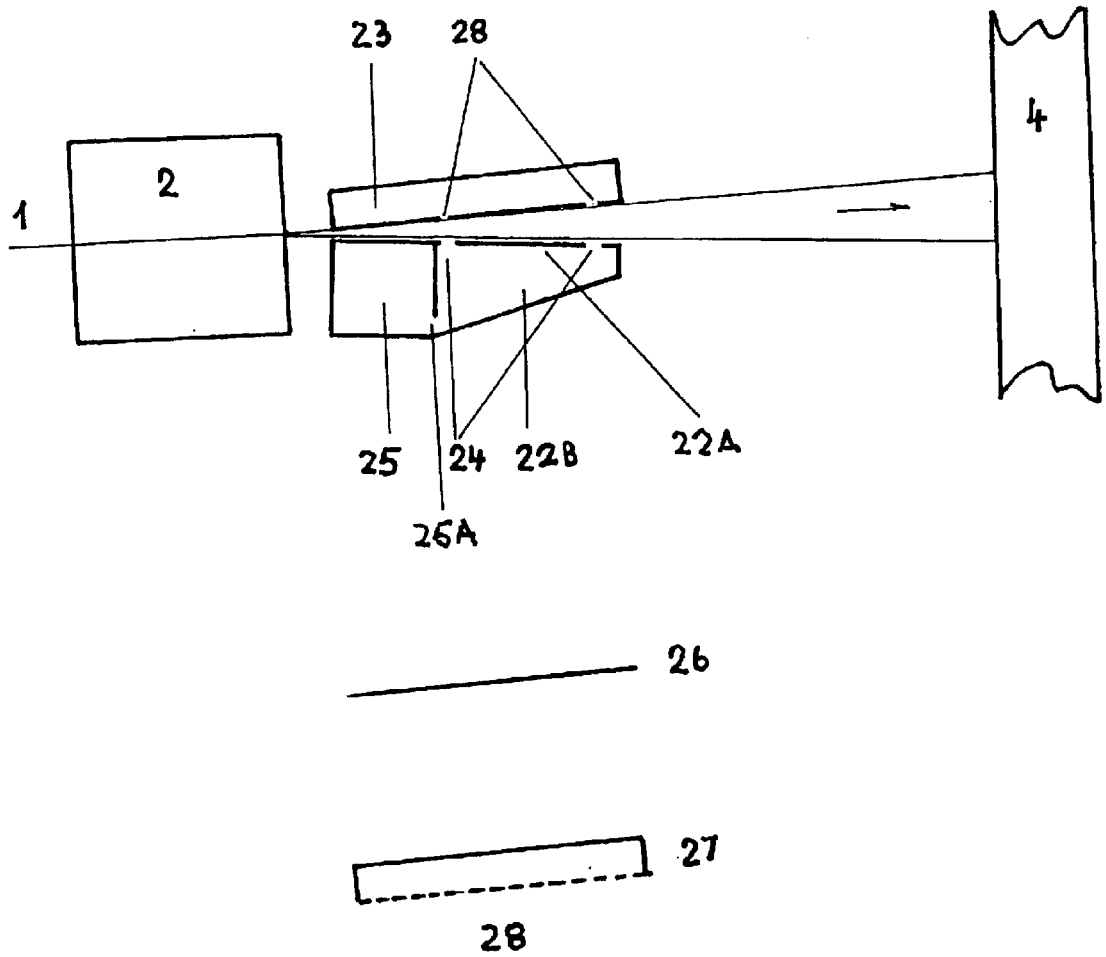
FIG. 5 is a schematic representation of the lint and dust vacuuming off device.

Solids fall out within the yarn break detector area is lesser. If convenient, a vacuuming plenum [21] will be installed (FIG. 4). The plate [21A] will guide the solids to the aspiration slot, part of said plenum [21].

The methods and the devices will be similar to those described above for the shed, adapted to a lesser fall out and to the specific weaving machine design. A cover, not shown in the drawing, attached to the shed cover [23], may also be included.

Lint and Dust Removal from the Filling Yarn

Filling yarn is fed from one or more bobbins, located in a creel, to one or more devices, called pre-feeders or yarn accumulators, which in turn feed the yarn tensionless to the insertion device (air jets, projectile, gripper). Two or more bobbins are tied end to beginning, in such a way as to assure continued feeding. One or more pre-feeding devices will feed yarn into the weaving machine.

The yarn leaving the bobbin at high speed (about 1500–2500 m/min) abrades against the bobbin's surface, thereby loosening fibers protruding from the yarn surface. Centrifugal forces disperse them into the surrounding area.

To lessen said abrasion and to improve the yarn strength and smoothness, an adequate quantity of fog will be supplied into this area (see "filling yarn moistening"). To prevent solids from escaping into the room, said creel will be loosely enclosed and a slight under-pressure will be maintained within, thereby preventing room contamination.

Said creels and pre-feeder are arranged in many different ways. For this reason, the moistening (see above) and the lint removal device will have to be adapted adequately to the weaving machine model.

Figure 6A:
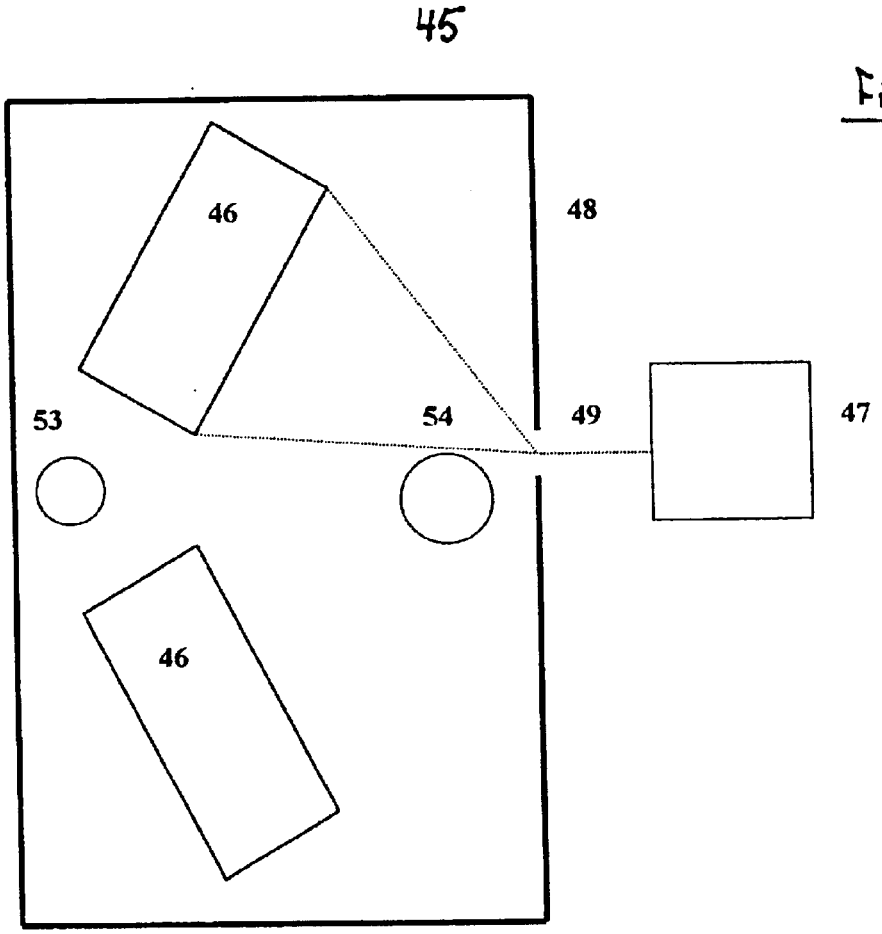
FIGS. 6A and 6B are schematic views (seen from above and from front side) of the filling yarn moistening and cleaning device.

FIG. 6A shows a typical arrangement [45], as seen from above. The pre-feeder [47] draws yarn from bobbin [46] (and later from its standby, shown also as [46]), through an opening [49] in a (usually) clear plastic division [48].

Figure 6B:
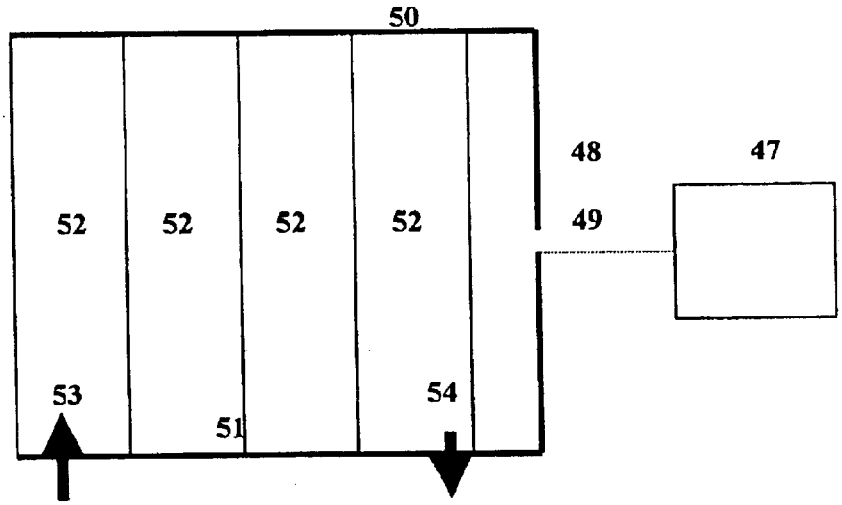

Seen from the front (FIG. 6B), stripes of clear and flexible plastic [52], attached to the roof [50] and extending to the bottom [51] enclose the remaining three sides of the creel. Said stripes are about 100 mm wide.

This arrangement allows visual control and easy replacement of empty bobbins.

An adequate amount of fog is conducted by a tube from the fogger and fed through the opening [53] into the creel enclosure. An adequate amount of air is removed through opening [54] and carried by a tube to the air filter, to be described later. Room air will enter the creel area through the stripes curtain [52] at higher speed than the speed of the loose fibers projected by the yarn.

Solids removal in each loom will be handled independently, including air filtration. Carrying air over long distances has high energy and materials costs. Air ducts are expensive and, when replacing looms, frequently they do not fit into the new lay out.

Figure 7:
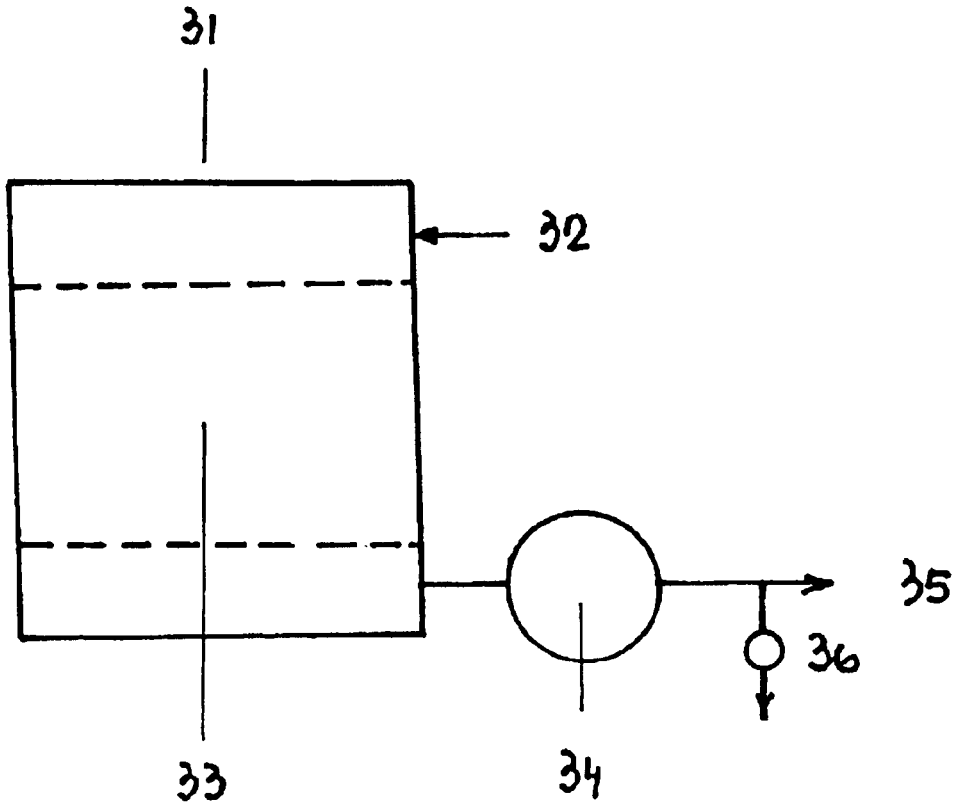
FIG. 7 is a schematic view of an air filter for removing lint and dust from air returning from warp and filling yarn cleaning devices.

Depending on existing in-plant infrastructure, any of the following alternatives may prove to be of advantage:

(1) A known porous [31] filter, as shown in FIG. 7. Contaminated air [32], returning from the devices described above, will enter the filter [33] impelled by the blower [34]. Part of the filtered air is bled by valve [36] into the room, in order to maintain the under-pressure mentioned above. Solids will be removed periodically by hand.

(2) Should a central vacuum system be available, said solids will be periodically vacuumed off from filter [31].

(3) A wet filter, usually known as air scrubber, is the preferred embodiment in this invention. Its solids retention is high, filtered air emerges cool and humid, and solids are carried away by water. Pipes and pumps are more economical than ducts and blowers.

Water will be recycled by an adequate external filtering device, such as a known rotary filter. Should a dye house be on the same premises, said water can be used untreated for de-sizing and scouring operations.

Figure 8:
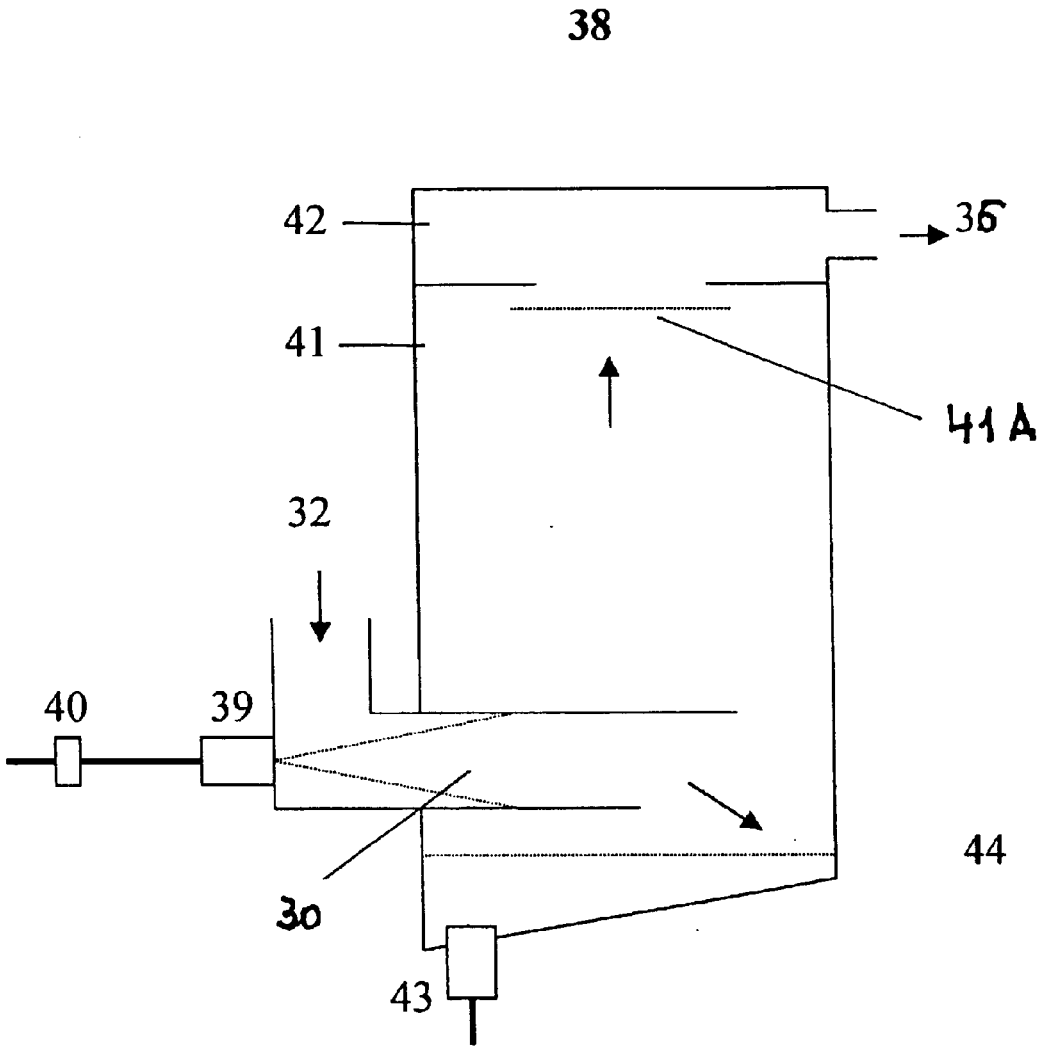
FIG. 8 is a schematic representation of an air scrubber.

As shown in FIG. 8, air carrying lint and dust [32]is sprayed with water by nozzle [39]. Thereafter, said airflow enters through tube [36] tangentially into the cylindrical body [41]. Water and solids accumulate at the bottom and are periodically discharged by valve [43] into an adequate piping system.

Clean and moist air raises at low speed to the top of [41], passes through filter into blower [42] and back to the cover [22].

Water valve [40] and blower [42] are shut off automatically when the loom stops.

Figure 9:
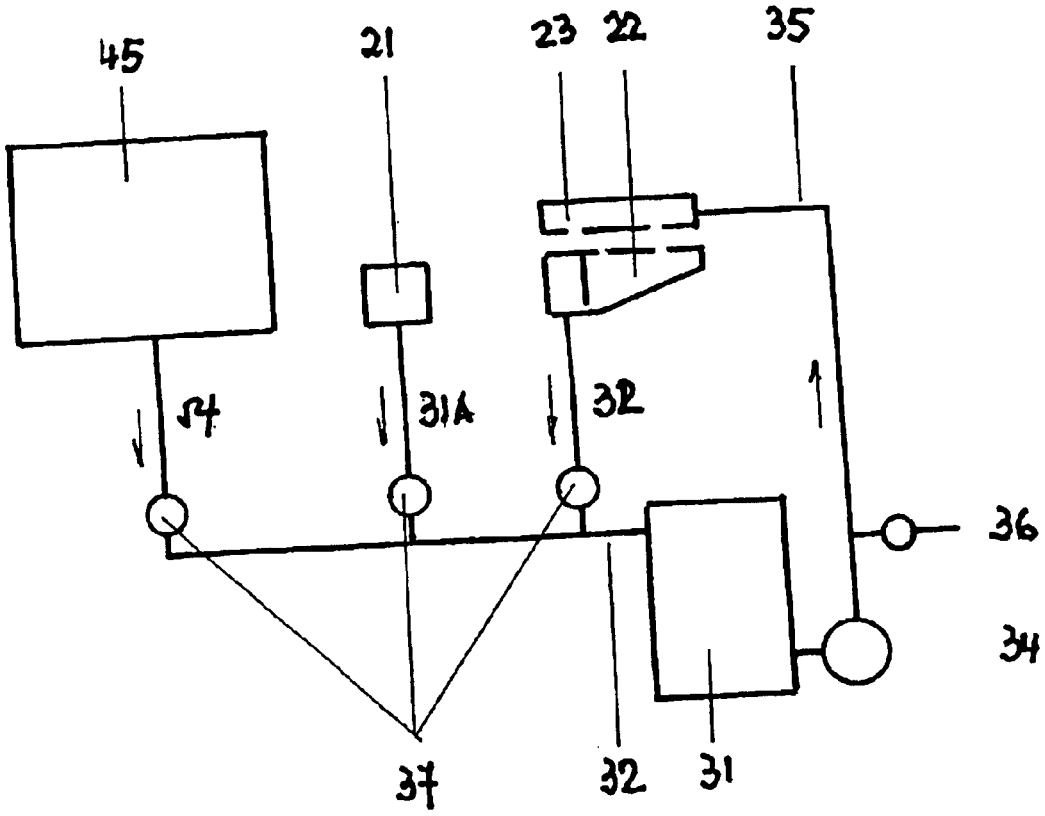
FIG. 9 is a schematic representation of the solids removal subsystem's air recycling devices.

In FIG. 9, the solids removal sub-system is represented schematically. Contaminated air is returned from the shed vacuuming device [22], the yarn break detector area [21], and the filling yarn area [45] through tubes [54], [31A], and [32]. Individual flow rates will be controlled by valves [37]. The adequate amount of air will be bled by valve [36], in order to adjust the correct under-pressure between cover [23] and vacuuming device [22].

Heat Removal

In high-speed looms, the main friction points and bearings are lubricated either by a central oil pump or, more frequently, by independent oil sinks and dispersing devices. As already stated, power consumed by the loom is totally converted into heat, and most of it transmitted to the oil.

Observations and measurements made on gripper looms showed that between 40–65% of the total heat is absorbed by the oil and then dissipated into the room air.

Figure 10:
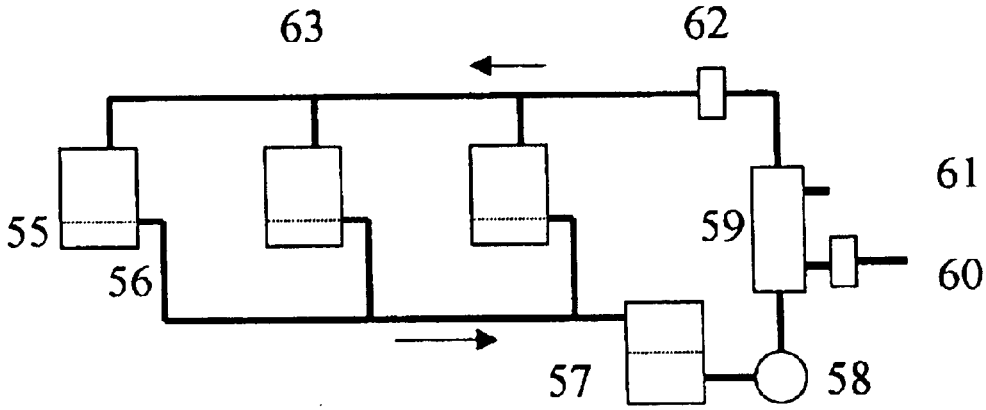
FIG. 10 is a schematic representation of external oil cooling device, to remove process heat from the looms.

FIG. 10 shows three independent oil sinks [55] and their usual oil level. Their number may vary between 2 and 8, depending on model and manufacturer. Overflowing oil is conducted through an adequate piping system [56] to an auxiliary sink [57]. The pump [58] impulses the oil from said sink through the heat exchanger [59] and the piping system [63] back to the sinks [55].

The heat exchanger will be of the plate type. Temperature is controlled by devices [62] for oil and [60] for water, adjusting the water flow rate in such a way as to maintain a set oil temperature.

Cooling water may be cooled by conventional means and recycled or, when a dye house is on the same location, may be used there untreated.

Room Air Conditioning

With yarn moistening and lint and dust removal accomplished, and the room heat-load reduced (by means described above) on every loom, the room conditioning system's requirements will be related mainly to human comfort. The now usual 70–80% room humidity can be reduced to 40–50%, thereby improving operator comfort. Additionally, no air moistening provisions will be necessary within the AC system.

The very low solids content in air returned to AC system reduces filtration requirements.

The considerably lower room heat load reduces the cooling requirements.

The three items above reduce the air turn over requirements to half.

Airflow will be inverted, from vertical downwards to vertical upwards, thereby minimizing turbulences.

Underground ducts are no longer necessary, thereby, investment costs are reduced, and layout flexibility is increased.

Decentralization of AC equipments, by replacing a few large units by many smaller and simpler units, further reduces energy consumed by air transport, as distances to and from AC are shortened.

Said small units, each serving the area of 4–16 weaving machines, will be located over or under the roof. The cooling (compressor, cooling tower) installation may be common (central) or part of each unit.

Figure 11:
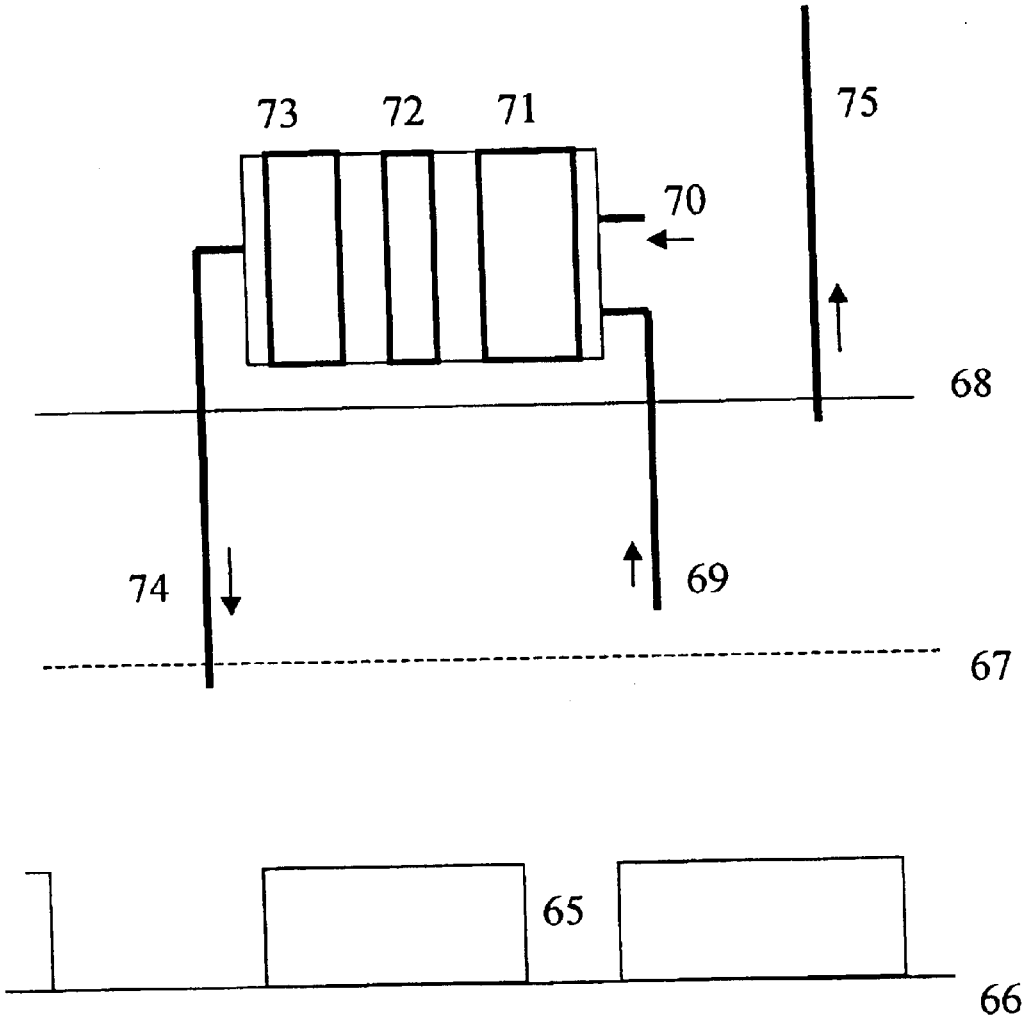
FIG. 11 is a schematic representation of the weaving air conditioning system.

FIG. 11 shows the outlay of the room air conditioning system schematically. The weaving machines [65] are located at floor level [66]. The operator comfort area in the aisles extends between floor level and its limit [67], about 3 meters above the floor. Therein, temperature and humidity will be held at set point +/−5% (centigrade).

The buffer area extends from level [67] to the roof [68]. Temperature at roof level will be less than 15° C. higher than in the comfort area. It reduces the external heat load.

Room air is returned to the AC unit (of the fan & coil type) by ducts with openings located over the looms at a level about 0.5 meters above [67]. Said air is cleaned by filter [71], propelled by fan [72] through a coil heat exchanger [73], and then distributed by ducts on the aisles. Air diffusers will be shaped in such a way as to direct the conditioned air to the floor. Provisions will be made as to reduce secondary air induction to a minimum.

Fresh air from the outside can be incorporated by [70] when convenient. An equivalent amount of the warmest air in the room will exit through chimneys [75], located near the roof.

In low buildings said buffer area will be omitted.

While specific embodiments of the invention have been described and illustrated herein, many changes and modifications in the invention may be made by those skilled in the art; modifications and changes that are covered by the invention if they come within the scope of the appended claims.

What is claimed is:

1. A weaving machine and weaving room conditioning system comprising:

a fog generating means for adding the necessary amount of fog to the yarn being fed into the loom to maintain a predetermined moisture content necessary for optimal performance in the weaving process;

a lint and dust removal means in contact with the warp to enclose the contamination zone and to prevent these solids, generated by the yarn during the weaving operation, from contaminating the weaving room air;

a loom heat removal means by cooling oil through a heat exchanger to reduce the heat load inside the weaving room; and an air conditioning means located over the looms, to improve both comfort and hygienic conditions and to reduce power consumption, means to evenly apply said fog on the yarn, and an automatic moisture controller to measure the water content of the yarn and to adjust the quantity of aerosol required to attain the desired set-point.

2. The weaving machine as in claim 1 wherein the lint and dust removal means comprising:

a vacuuming off device placed under the shed, in contact with the warp yarns;

a cover over the shed, also in contact with the warp yarns;

a sharp airflow through nozzles in said over, impinging on the warp yarns;

a blower to circulate the air from the aspiration device through filter means and to the nozzles; and filtering means to retain the solids.

3. The weaving machine as in claim 1 wherein the loom cooling means comprising:

an external oil re-circulating means;

a surface oil to water heat exchanger; and an automatic oil temperature controller.

4. The weaving room air conditioning means as in claim 1 further comprising:

small air conditioning units, close to the weaving room roof, each serving the area of a small number of looms;

louvers to project the conditioned air towards the weaving room aisles; and ducts placed over the looms to extract warm air from under the roof.

* * * * *